US010928763B2

(12) United States Patent
Shimada et al.

(10) Patent No.: US 10,928,763 B2
(45) Date of Patent: Feb. 23, 2021

(54) FIXING DEVICE AND IMAGE FORMING APPARATUS

(71) Applicants: Hiroyuki Shimada, Tokyo (JP); Hiroshi Yoshinaga, Chiba (JP); Hitoshi Fujiwara, Kanagawa (JP)

(72) Inventors: Hiroyuki Shimada, Tokyo (JP); Hiroshi Yoshinaga, Chiba (JP); Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/845,756

(22) Filed: Apr. 10, 2020

(65) Prior Publication Data

US 2020/0341419 A1 Oct. 29, 2020

(30) Foreign Application Priority Data

Apr. 26, 2019 (JP) ..... 2019-085727

(51) Int. Cl.
*G03G 15/20* (2006.01)
*G03G 21/16* (2006.01)

(52) U.S. Cl.
CPC ..... *G03G 15/2053* (2013.01); *G03G 15/2039* (2013.01); *G03G 15/2064* (2013.01); *G03G 21/1619* (2013.01); *G03G 21/1633* (2013.01)

(58) Field of Classification Search
CPC ..... G03G 15/2017; G03G 15/2039; G03G 15/2053; G03G 15/2064; G03G 21/1619; G03G 21/1685; G03G 2215/2003; G03G 2221/1639; G03G 21/1633
See application file for complete search history.

(56) References Cited

U.S. PATENT DOCUMENTS

| | | | | |
|---|---|---|---|---|
| 7,555,233 | B2 * | 6/2009 | Shiobara | G03G 15/2039 399/330 |
| 2015/0030345 | A1 * | 1/2015 | Murakami | G03G 15/2039 399/69 |
| 2016/0334740 | A1 * | 11/2016 | Tokunaga | G03G 15/2017 |
| 2017/0090364 | A1 * | 3/2017 | Yotsutsuji | G03G 15/2039 |
| 2018/0059587 | A1 | 3/2018 | Sawada et al. | |
| 2018/0059598 | A1 | 3/2018 | Hasegawa et al. | |

(Continued)

FOREIGN PATENT DOCUMENTS

| | | |
|---|---|---|
| JP | 2003-287977 | 10/2003 |
| JP | 2009-053245 | 3/2009 |

(Continued)

OTHER PUBLICATIONS

U.S. Appl. No. 16/736,876, filed Jan. 8, 2020, Hiroyuki Shimada.

*Primary Examiner* — Sophia S Chen
(74) *Attorney, Agent, or Firm* — Oblon, McClelland, Maier & Neustadt, L.L.P.

(57) ABSTRACT

A fixing device includes a rotator that rotates and a fixing device cover. The fixing device cover includes an interior face that is disposed opposite the rotator, a first aperture that is disposed opposite the rotator, and a recess that surrounds the first aperture and extends in a gravity direction. A frame is interposed between the interior face of the fixing device cover and the rotator. The frame includes a second aperture that is disposed opposite the rotator and the first aperture. A rib is mounted on the frame and extends from the second aperture toward the interior face of the fixing device cover.

13 Claims, 8 Drawing Sheets

(56) References Cited

U.S. PATENT DOCUMENTS

| | | | | |
|---|---|---|---|---|
| 2018/0120741 | A1 | 5/2018 | Yoshinaga et al. | |
| 2018/0157198 | A1 | 6/2018 | Seto et al. | |
| 2018/0173138 | A1 | 6/2018 | Seki et al. | |
| 2018/0284669 | A1 | 10/2018 | Fujimoto et al. | |
| 2019/0286025 | A1 | 9/2019 | Yamaguchi et al. | |
| 2019/0339645 | A1* | 11/2019 | Mogi ..... | G03G 15/2064 |
| 2020/0033777 | A1 | 1/2020 | Fujimoto et al. | |

FOREIGN PATENT DOCUMENTS

| | | |
|---|---|---|
| JP | 2014-112193 | 6/2014 |
| JP | 2015-172700 | 10/2015 |
| JP | 2016-148714 | 8/2016 |
| JP | 2016-148715 | 8/2016 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-085727, filed on Apr. 26, 2019, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device provided with a non-contact temperature sensor (e.g., a thermopile) that detects the temperature of a detected object.

No component is disposed in a space between the detected object (e.g., a fixing member or a fixing rotator) and the non-contact temperature sensor to prevent the non-contact temperature sensor from detecting the temperature of the detected object erroneously. Accordingly, no shield is provided for the non-contact temperature sensor, causing an air current, that contains water vapor generated from a sheet heated during printing, to reach the non-contact temperature sensor easily. Consequently, a part (e.g., a lens mainly) of the non-contact temperature sensor may suffer from condensation, causing the non-contact temperature sensor to detect the temperature of the detected object imprecisely.

SUMMARY

This specification describes below an improved fixing device. In one embodiment, the fixing device includes a rotator that rotates and a fixing device cover. The fixing device cover includes an interior face that is disposed opposite the rotator, a first aperture that is disposed opposite the rotator, and a recess that surrounds the first aperture and extends in a gravity direction. A frame is interposed between the interior face of the fixing device cover and the rotator. The frame includes a second aperture that is disposed opposite the rotator and the first aperture. A rib is mounted on the frame and extends from the second aperture toward the interior face of the fixing device cover.

This specification further describes an improved image forming apparatus. In one embodiment, the image forming apparatus includes a fixing device that fixes an image on a recording medium and a non-contact temperature sensor that is disposed outside the fixing device. The fixing device includes a detected object, of which temperature is detected by the non-contact temperature sensor, and a fixing device cover. The fixing device cover includes an interior face that is disposed opposite the detected object, a first aperture that is disposed opposite the non-contact temperature sensor, and a recess that surrounds the first aperture and extends in a gravity direction. A frame is interposed between the interior face of the fixing device cover and the detected object. The frame includes a second aperture disposed opposite the non-contact temperature sensor. A rib is mounted on the frame. The rib extends from the second aperture toward the interior face of the fixing device cover.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
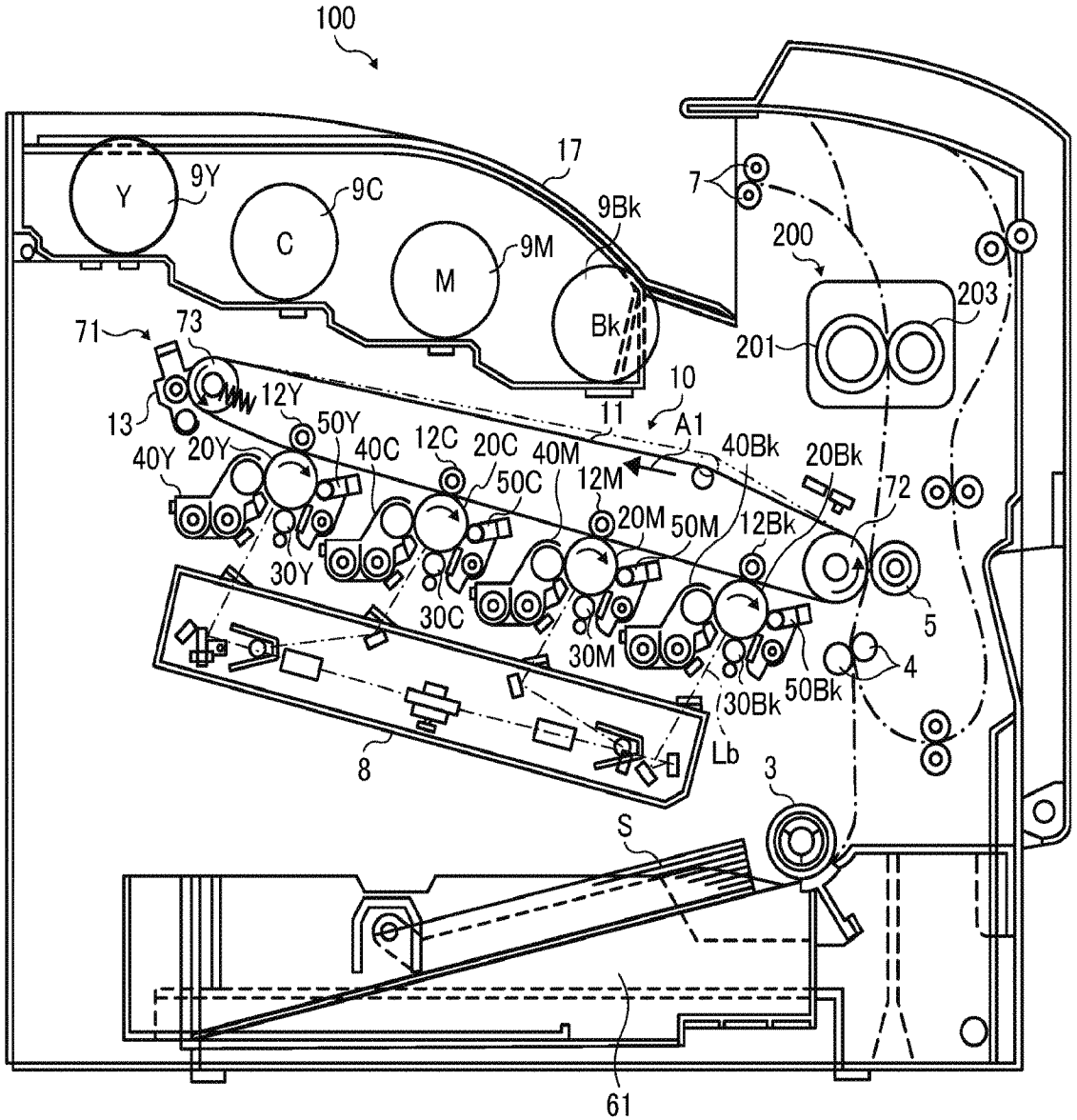
FIG. 1 is a cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure. In order to clarify the description, the description below and the drawings are omitted or simplified properly. In the drawings, identical reference numerals are assigned to components and equivalents that have an identical construction or an identical function and a description of those components and the equivalents is omitted.

Referring to FIG. 1, the following describes a construction of an image forming apparatus 100 that employs a fixing device 200 according to an embodiment of the present disclosure as one example.

The image forming apparatus 100 illustrated in FIG. 1 is a color printer employing a tandem system in which a plurality of image forming devices that forms images in a plurality of colors, respectively, is aligned in a stretch direction of a transfer belt 11. Alternatively, the fixing device 200 according to this embodiment may be installed in image forming apparatuses employing systems other than the tandem system. According to this embodiment, the image forming apparatus 100 is a printer. Alternatively, the image forming apparatus 100 may be a copier, a facsimile machine, or the like.

The image forming apparatus 100 employs the tandem system in which photoconductive drums 20Y, 20C, 20M, and 20Bk are aligned. The photoconductive drums 20Y, 20C, 20M, and 20Bk serve as image bearers that bear images in yellow, cyan, magenta, and black as color separation components, respectively.

In the image forming apparatus 100, visible images formed on the photoconductive drums 20Y, 20C, 20M, and 20Bk, respectively, are transferred onto the transfer belt 11 in a primary transfer process such that the visible images are superimposed on the transfer belt 11. The transfer belt 11 serves as an intermediate transferor, that is, an endless belt that rotates in a direction A1 while the transfer belt 11 is disposed opposite the photoconductive drums 20Y, 20C, 20M, and 20Bk. In the primary transfer process, yellow, cyan, magenta, and black toner images are transferred onto the transfer belt 11 such that the yellow, cyan, magenta, and black toner images are superimposed on the transfer belt 11. Thereafter, the visible images formed on the transfer belt 11 are transferred collectively onto a recording medium S (e.g., a recording sheet) in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates. Taking the photoconductive drum 20Bk that forms the black toner image as an example, a charger 30Bk, a developing device 40Bk, a primary transfer roller 12Bk, and a cleaner 50Bk which form the black toner image are disposed in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are disposed in a rotation direction of the photoconductive drums 20Y, 20C, and 20M, respectively. An optical writing device 8 is used for writing with a light beam Lb after the charger 30Bk charges the photoconductive drum 20Bk.

While the transfer belt 11 rotates in the direction A1, the visible images formed on the photoconductive drums 20Y, 20C, 20M, and 20Bk, respectively, are transferred onto the transfer belt 11 such that the visible images are superimposed on a same position on the transfer belt 11. The primary transfer rollers 12Y, 12C, 12M, and 12Bk disposed opposite the photoconductive drums 20Y, 20C, 20M, and 20Bk via the transfer belt 11 apply voltage to transfer the visible images formed on the photoconductive drums 20Y, 20C, 20M, and 20Bk at different times from the upstream photoconductive drum 20Y to the downstream photoconductive drum 20Bk in the direction A1.

The photoconductive drums 20Y, 20C, 20M, and 20Bk are aligned in this order from upstream to downstream in the direction A1. Imaging stations that form the yellow, cyan, magenta, and black toner images include the photoconductive drums 20Y, 20C, 20M, and 20Bk, respectively.

The image forming apparatus 100 includes four imaging stations, a transfer belt unit 10, a secondary transfer roller 5, a belt cleaner 13, and the optical writing device 8. The four imaging stations form the yellow, cyan, magenta, and black toner images, respectively. The transfer belt unit 10 is disposed opposite and above the photoconductive drums 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotates in accordance with rotation of the transfer belt 11. The belt cleaner 13 is disposed opposite the transfer belt 11 and cleans the transfer belt 11. The optical writing device 8 is disposed opposite and below the four imaging stations.

The optical writing device 8 includes a semiconductor laser serving as a light source, a coupling lens, an f-θ lens, a toroidal lens, a reflection mirror, and a polygon mirror serving as a deflector. The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively. Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 includes a sheet feeding tray (e.g., a paper tray) that loads recording media S to be conveyed to a secondary transfer nip formed between the secondary transfer roller 5 and the transfer belt 11. The registration roller pair 4 feeds the recording medium S conveyed from the sheet feeder 61 to the secondary transfer nip formed between the secondary transfer roller 5 and the transfer belt 11 at a predetermined time when the yellow, cyan, magenta, and black toner images formed on the transfer belt 11 by the imaging stations reach the secondary transfer nip. The sensor detects that a leading edge of the recording medium S reaches the registration roller pair 4.

The image forming apparatus 100 further includes the fixing device 200, a sheet ejection roller pair 7, a sheet ejection tray 17, and toner bottles 9Y, 9C, 9M, and 9Bk. The fixing device 200 is a fuser unit that fixes a color toner image on the recording medium S in a belt fixing method. The color toner image is formed by transferring the yellow, cyan, magenta, and black toner images formed on the transfer belt 11 onto the recording medium S. The sheet ejection roller pair 7 ejects the recording medium S bearing the fixed color toner image onto an outside of a body of the image forming apparatus 100. The sheet ejection tray 17 (e.g., an output tray) is disposed atop the body of the image forming apparatus 100. The sheet ejection tray 17 stacks the recording media S ejected onto the outside of the body of the image forming apparatus 100 by the sheet ejection roller pair 7. The toner bottles 9Y, 9C, 9M, and 9Bk are disposed below the sheet ejection tray 17 and replenished with yellow, cyan, magenta, and black toners, respectively.

In addition to the transfer belt 11 and the primary transfer rollers 12Y, 12C, 12M, and 12Bk, the transfer belt unit 10 includes a driving roller 72 and a driven roller 73 over which the transfer belt 11 is looped.

The driven roller 73 also serves as a tension applicator that applies tension to the transfer belt 11. Hence, a biasing member such as a spring biases the driven roller 73 against the transfer belt 11. The transfer belt unit 10, the primary transfer rollers 12Y, 12C, 12M, and 12Bk, the secondary transfer roller 5, and the belt cleaner 13 construct a transfer device 71.

The sheet feeder 61 is disposed in a lower portion of the body of the image forming apparatus 100. The sheet feeder 61 includes a sheet feeding roller 3 that comes into contact with an upper surface of an uppermost recording medium S. As the sheet feeding roller 3 is driven and rotated counter-clockwise in FIG. 1, the sheet feeding roller 3 feeds the uppermost recording medium S to the registration roller pair 4.

The belt cleaner 13 installed in the transfer device 71, although the belt cleaner 13 is schematically illustrated in FIG. 1, includes a cleaning brush and a cleaning blade that are disposed opposite and brought into contact with the transfer belt 11. The cleaning brush and the cleaning blade of the belt cleaner 13 scrape and remove a foreign substance such as residual toner from the transfer belt 11, cleaning the transfer belt 11.

The belt cleaner 13 further includes a discharging device that conveys the residual toner removed from the transfer belt 11 for disposal.

A description is provided of a construction of the fixing device 200.

Figure 2:
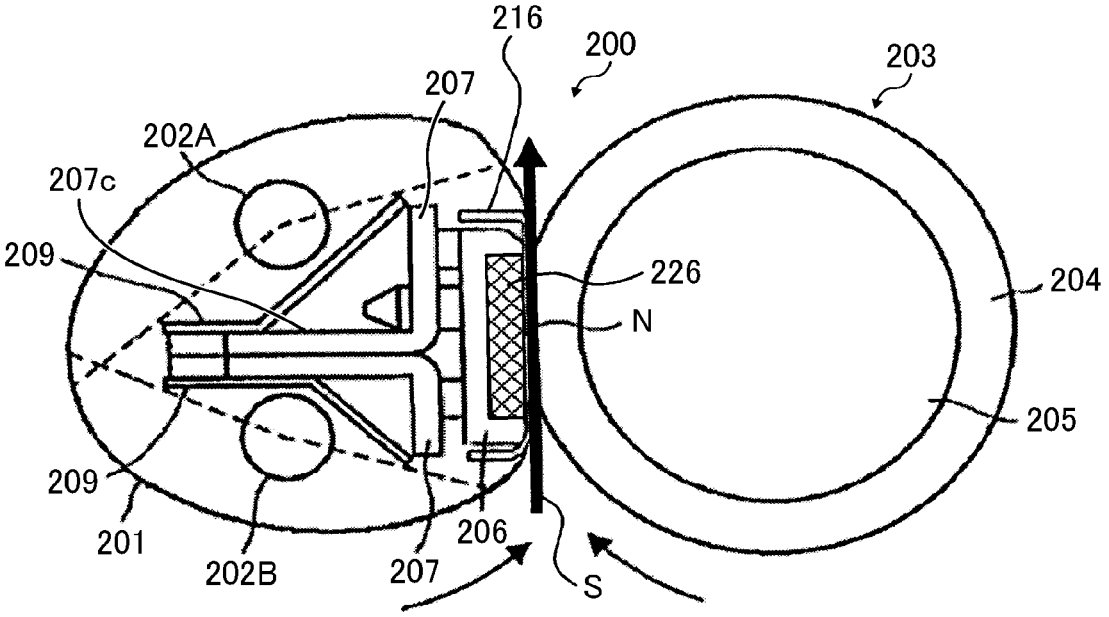
FIG. 2 is a schematic cross-sectional view of a fixing device incorporated in the image forming apparatus depicted in FIG. 1 as one example.

FIG. 2 is a schematic cross-sectional view of the fixing device 200 according to an embodiment of the present disclosure as one example.

The fixing device 200 includes a fixing belt 201 and a pressure roller 203. The fixing belt 201 serves as a fixing rotator or a fixing member that is rotatable in a rotation direction indicated by an arrow in FIG. 2. The pressure roller 203 serves as a pressure rotator or a pressure member that is disposed opposite the fixing belt 201 and rotatable in a rotation direction indicated by an arrow in FIG. 2. Halogen heaters 202A and 202B serve as a plurality of heat sources or heaters that is disposed opposite an inner circumferential surface of the fixing belt 201. The halogen heaters 202A and 202B heat the fixing belt 201 directly with radiant heat.

A nip former 206 (e.g., a nip forming pad) is disposed inside a loop formed by the fixing belt 201. The nip former 206 presses against the pressure roller 203 via the fixing belt 201 to form a fixing nip N between the fixing belt 201 and the pressure roller 203. The inner circumferential surface of the fixing belt 201 slides over the nip former 206 indirectly via a thermal conduction aid 216. As a recording medium S bearing a toner image is conveyed through the fixing nip N, the fixing belt 201 and the pressure roller 203 fix the toner image on the recording medium S under heat and pressure.

The thermal conduction aid 216 illustrated in FIG. 2 is planar. Alternatively, the thermal conduction aid 216 may be curved or concave or may have other shapes. If the thermal conduction aid 216 is concave to define the fixing nip N that is concave, the leading edge of the recording medium S is directed to the pressure roller 203 when the recording medium S is ejected from the fixing nip N, facilitating separation of the recording medium S from the fixing belt 201 and thereby preventing the recording medium S from being jammed.

Inside the loop formed by the fixing belt 201 are the nip former 206, lateral end heaters 226, the thermal conduction aid 216, and a stay 207. The nip former 206 is disposed opposite the pressure roller 203 via the fixing belt 201. The lateral end heaters 226, serving as lateral end heat sources, are disposed at both lateral ends of the nip former 206 in a longitudinal direction thereof, respectively. The lateral end heaters 226 are coupled with the nip former 206. The thermal conduction aid 216 covers an opposed face of each of the nip former 206 and the lateral end heaters 226, that is disposed opposite the inner circumferential surface of the fixing belt 201. The stay 207 supports the nip former 206 against pressure from the pressure roller 203.

Each of the nip former 206, the thermal conduction aid 216, and the stay 207 has a length not smaller than a length of the fixing belt 201 in an axial direction, that is, a longitudinal direction, of the fixing belt 201.

The thermal conduction aid 216 prevents heat generated by the lateral end heaters 226 from being stored locally. The thermal conduction aid 216 facilitates conduction of heat in a longitudinal direction thereof and decreases unevenness of the temperature of the fixing belt 201 in the longitudinal direction thereof.

Hence, the thermal conduction aid 216 is preferably made of a material that conducts heat in a shortened time period. For example, the thermal conduction aid 216 is preferably made of a material having an increased thermal conductivity, such as copper, aluminum, and silver. Copper is most preferable by comprehensively considering costs, availability, thermal conductivity, and processing.

According to this embodiment, an opposed face of the thermal conduction aid 216, that is disposed opposite the inner circumferential surface of the fixing belt 201, serves as a nip forming face that contacts the fixing belt 201 directly.

A detailed description is now given of a construction of the fixing belt 201.

The fixing belt 201 is an endless belt or film made of metal such as nickel and SUS stainless steel or resin such as polyimide. The fixing belt 201 includes a base and a release layer. The release layer serves as a surface layer made of tetrafluoroethylene-perfluoroalkylvinylether copolymer (PFA), polytetrafluoroethylene (PTFE), or the like, facilitating separation of the recording medium S from the fixing belt 201 and preventing toner from adhering to the fixing belt 201. Optionally, an elastic layer made of silicone rubber or the like may be interposed between the base and the release layer. If the fixing belt 201 does not incorporate the elastic layer, the fixing belt 201 attains a decreased thermal capacity that improves a fixing property of being heated quickly. However, when the pressure roller 203 presses and deforms an unfixed toner image to fix the toner image on the recording medium S, slight surface asperities of the fixing belt 201 may be transferred onto the toner image, causing a disadvantage that an orange peel mark remains on a solid part of the toner image as variation in gloss of the toner image or an orange peel image. To address this circumstance, the elastic layer has a thickness of 100 micrometers or more. As the elastic layer deforms, the elastic layer absorbs the slight surface asperities, preventing the orange peel mark on the toner image.

A detailed description is now given of a construction of the stay 207.

The stay 207 includes a base and an arm 207*c* that projects from the base. The arm 207*c* is disposed opposite the fixing nip N via the base. The halogen heater 202A serving as a fixing heater is disposed opposite the halogen heater 202B serving as a fixing heater via the arm 207*c*. The halogen heaters 202A and 202B disposed opposite the inner circumferential surface of the fixing belt 201 heat the fixing belt 201 directly with radiant heat.

The nip former 206 and the stay 207 serving as a support that supports the nip former 206 to define the fixing nip N are disposed inside the loop formed by the fixing belt 201. The stay 207 prevents the nip former 206 from being bent by pressure from the pressure roller 203, attaining a uniform length of the fixing nip N in a recording medium conveyance direction throughout an entire length of the fixing belt 201 in the axial direction thereof. Both ends of the stay 207 in the axial direction of the fixing belt 201 are supported by and secured to flanges serving as holders, respectively, thus being positioned inside the loop formed by the fixing belt 201. The fixing device 200 further includes a reflector 209 interposed between the halogen heater 202A and the stay 207 and another reflector 209 interposed between the halogen heater 202B and the stay 207. The reflectors 209 reflect radiant heat and the like from the halogen heaters 202A and 202B, suppressing heating of the stay 207 with radiant heat and the like and resultant waste of energy. Instead of the reflectors 209, a surface of the stay 207 may be treated with thermal insulation or mirror finish to attain similar advantages.

A detailed description is now given of a construction of the pressure roller 203.

The pressure roller 203 includes a cored bar 205, an elastic rubber layer 204, and a release layer. The elastic rubber layer 204 is disposed on the cored bar 205. The release layer serves as a surface layer that facilitates separation of the recording medium S from the pressure roller 203. The release layer is made of PFA, PTFE, or the like. A driving force is transmitted to the pressure roller 203 from a driver such as a motor disposed in the image forming apparatus 100 through a gear, thus rotating the pressure roller 203. A spring or the like presses the pressure roller 203 against the fixing belt 201. As the spring presses and deforms the elastic rubber layer 204, the pressure roller 203 forms the fixing nip N having a predetermined length in the recording medium conveyance direction. The pressure roller 203 may be a solid roller or a hollow roller. Alternatively, a heater such as a halogen heater may be disposed inside the pressure roller 203. The elastic rubber layer 204 may be made of solid rubber. Alternatively, if no heater is disposed inside the pressure roller 203, sponge rubber may be used. The sponge rubber enhances thermal insulation of the pressure roller 203, preferably causing the pressure roller 203 to draw less heat from the fixing belt 201.

The fixing belt 201 rotates in accordance with rotation of the pressure roller 203. With the construction of the fixing device 200 illustrated in FIG. 2, as the driver drives and rotates the pressure roller 203, the driving force is transmitted from the pressure roller 203 to the fixing belt 201 at the fixing nip N, rotating the fixing belt 201 in accordance with rotation of the pressure roller 203. The fixing belt 201 rotates while the nip former 206 and the pressure roller 203 sandwich the fixing belt 201 at the fixing nip N. The fixing belt 201 rotates while the flanges guide the fixing belt 201 at both lateral ends of the fixing belt 201 in the axial direction thereof in a circumferential span of the fixing belt 201 other than the fixing nip N.

With the construction described above, the fixing device 200 attaining quick warmup is manufactured at reduced costs.

Figure 3:
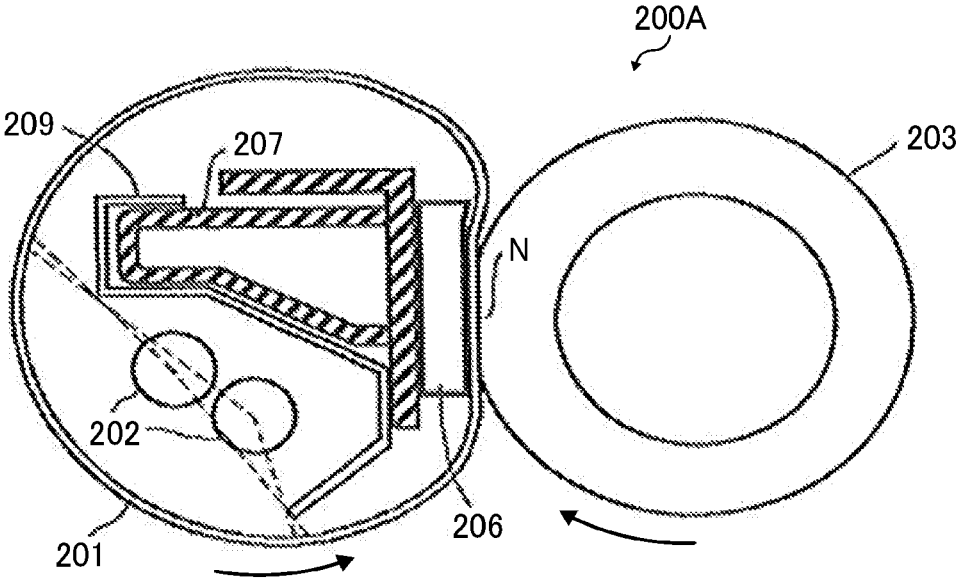
FIG. 3 is a schematic cross-sectional view of a fixing device installable in the image forming apparatus depicted in FIG. 1 as another example.

FIG. 3 is a schematic cross-sectional view of a fixing device 200A according to an embodiment of the present disclosure as another example.

The fixing device 200A includes two halogen heaters 202. Alternatively, the fixing device 200A may include one halogen heater 202 or three or more halogen heaters 202.

A detailed description is now given of a construction of a fixing device according to an embodiment of the present disclosure.

Since a recording medium S is heated during printing, moisture contained in the recording medium S evaporates into water vapor that diffuses inside the fixing device incorporated in the image forming apparatus 100 that forms the toner image on the recording medium S by electrophotography. For example, when the image forming apparatus 100 is cool, peripheral components of the fixing device may suffer from condensation. If the fixing device employs a non-contact temperature sensor, since no shield is interposed between a fixing rotator and the non-contact temperature sensor, an air current containing water vapor may reach a thermopile. A receiver of the thermopile receives infrared light from a detected object, thus detecting the temperature of the detected object. If the receiver suffers from condensation, the thermopile may detect the temperature of the detected object erroneously.

A description is provided of a construction of a comparative fixing device.

The comparative fixing device includes a first air duct and a second air duct. The first air duct is interposed between a non-contact temperature sensor and a detected object (e.g., a fixing roller). The second air duct is disposed opposite the fixing roller via the non-contact temperature sensor. A wind velocity of air inside the first air duct is greater than a wind velocity of air inside the second air duct.

However, the comparative fixing device may increase the number of parts.

To address this circumstance, the fixing device according to the embodiment of the present disclosure incorporates an air duct that extends vertically to prevent the air current containing water vapor from blowing against the non-contact temperature sensor directly. Instead of adding an extra component exclusively used as the air duct, a sensor aperture in a fixing device cover is recessed into the air duct, suppressing increase in the number of parts.

The fixing device according to the embodiment of the present disclosure includes the fixing device cover, a frame disposed in an interior defined by the fixing device cover, the detected object (e.g., a fixing rotator) disposed inside the fixing device, and the non-contact temperature sensor, which have shapes described below, respectively.

The non-contact temperature sensor is disposed opposite the detected object via the fixing device cover.

The fixing device cover is provided with the sensor aperture through which infrared light emitted from the detected object irradiates the non-contact temperature sensor.

The fixing device cover includes a recess that is disposed in proximity to the sensor aperture and is extended vertically in a gravity direction.

A structure (e.g., the frame) is interposed between an interior face of the fixing device cover and the detected object. The frame includes a sensor aperture like the fixing device cover. The sensor aperture of the frame mounts a rib that faces the interior face of the fixing device cover and decreases a gap between the sensor aperture and the fixing device cover.

A description is provided of embodiments of the fixing device described above.

A description is provided of a construction of a fixing device 300 according to a first embodiment of the present disclosure.

The fixing device 300 is installable in the image forming apparatus 100 depicted in FIG. 1.

Figure 4:
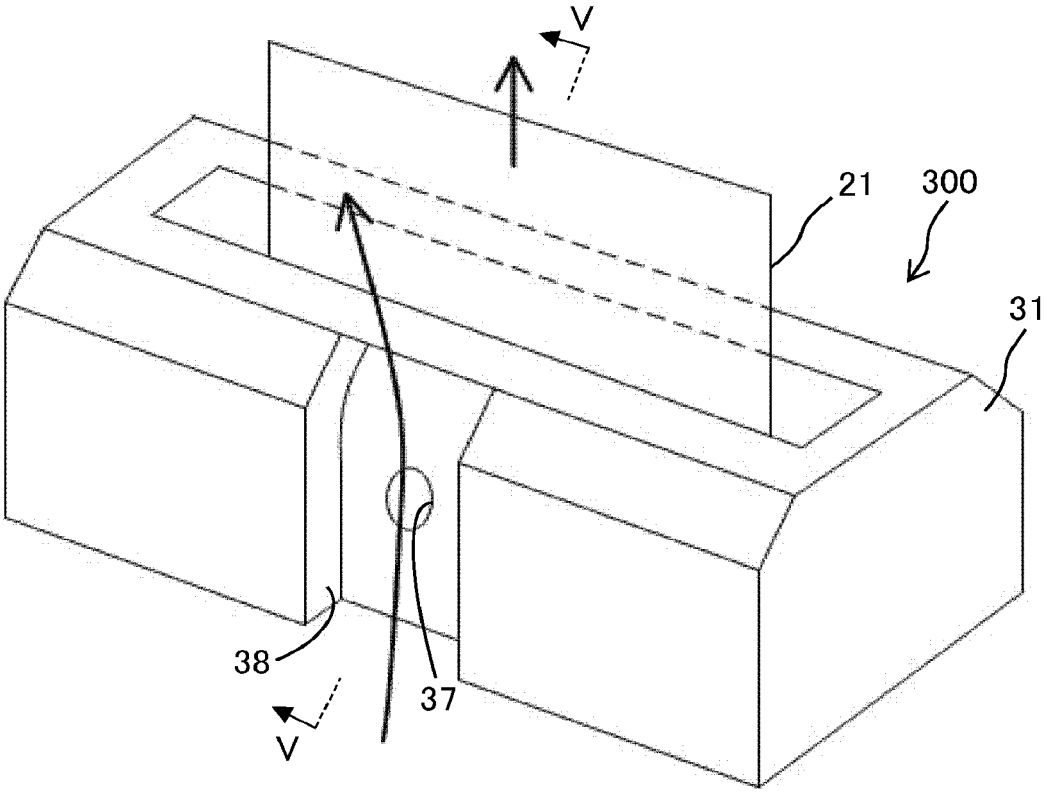
FIG. 4 is a perspective view of a fixing device according to a first embodiment of the present disclosure, that is installable in the image forming apparatus depicted in FIG. 1, illustrating an exterior of the fixing device.

FIG. 4 is a perspective view of the fixing device 300 according to an embodiment of the present disclosure, illustrating an exterior of the fixing device 300. FIG. 4 illustrates a fixing device cover 31 as an exterior cover of the fixing device 300. A sheet 21 as one example of the recording medium S is ejected from the fixing device 300.

The fixing device cover 31 includes an aperture 37 serving as a first aperture. The aperture 37 is a through hole through which a non-contact temperature sensor receives infrared light emitted from a detected object.

The fixing device cover 31 includes a recess 38 that is disposed in proximity to the aperture 37 and is extended vertically in the gravity direction. The recess 38 is recessed inward toward an interior defined by the fixing device cover 31. For example, the recess 38 disposed in proximity to the aperture 37 surrounds the aperture 37 to define a surrounding region that surrounds the aperture 37. The recess 38 preferably extends vertically in the gravity direction to both ends of an aperture mounting face provided with the aperture 37. In other words, the aperture 37 is mounted on a recessed face, that is, the aperture mounting face.

Accordingly, the recess 38 recesses a vicinity of the aperture 37, defining an air duct where an air current flows.

Figure 5:
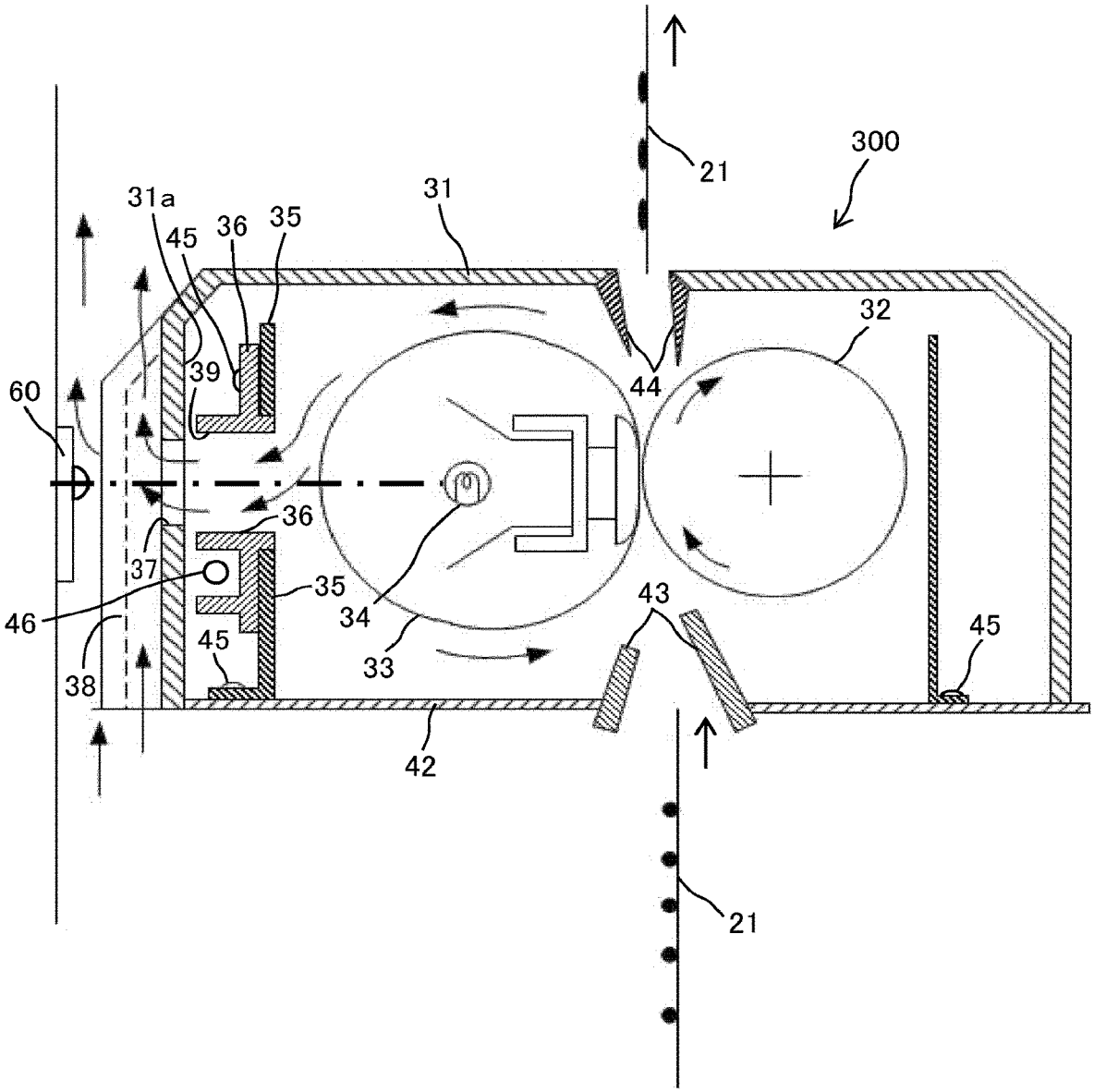
FIG. 5 is a cross-sectional view of the fixing device depicted in FIG. 4.

Referring to FIG. 5, a description is provided of a cross section of the fixing device 300 according to the first embodiment.

FIG. 5 is a cross-sectional view of the fixing device 300 taken on line V-V in FIG. 4. FIG. 5 illustrates a non-contact temperature sensor 60 that is disposed outside the fixing device 300 and disposed inside the body of the image forming apparatus 100. Alternatively, the non-contact temperature sensor 60 may be disposed outside the fixing device cover 31 and incorporated in the fixing device 300.

FIG. 5 illustrates one example of the construction of the fixing device 300 that includes the fixing device cover 31, a pressure roller 32 serving as a pressure rotator or a pressure member, a fixing belt 33 serving as a fixing rotator or a fixing member, a halogen heater 34, a frame 35 (e.g., a unit frame), a rib 36, a substrate 42, a first sheet guide 43, a second sheet guide 44, screws 45, and a harness 46.

The non-contact temperature sensor 60 detects the temperature of the fixing belt 33 serving as a detected object. The non-contact temperature sensor 60 is disposed opposite the fixing belt 33 via the fixing device cover 31. The non-contact temperature sensor 60 detects the temperature of the fixing belt 33 through the aperture 37.

The non-contact temperature sensor 60 includes a lens that faces a center of a loop formed by the fixing belt 33 as illustrated with an alternate long and short dash line in FIG. 5.

The frame 35 is a structure interposed between an interior face 31*a* of the fixing device cover 31 and the fixing belt 33. Like the fixing device cover 31, the frame 35 includes an aperture 39 serving as a second aperture. Infrared light emitted from the detected object (e.g., the fixing belt 33) irradiates the non-contact temperature sensor 60 through the aperture 37 of the fixing device cover 31 and the aperture 39 of the frame 35. For example, the apertures 37 and 39 are disposed opposite the fixing belt 33.

The rib 36 is mounted on the frame 35 to reinforce the frame 35. The rib 36 is mounted on the aperture 39 of the frame 35 such that the rib 36 faces the interior face 31*a* of the fixing device cover 31 and decreases a gap between the rib 36 mounted on the frame 35 and the interior face 31*a* of the fixing device cover 31. Hence, the aperture 39 of the frame has a shape enclosed by the rib 36. For example, the rib 36 defines an inner face of the aperture 39. FIG. 5 illustrates an aperture (e.g., a through hole) defined by the rib 36 mounted on the frame 35 as the aperture 39 of the frame 35.

FIG. 5 illustrates the rib 36 made of resin as one example. Alternatively, the rib 36 may be manufactured by sheet metal processing.

Air warmed by the fixing device 300 moves upward to generate an air current (e.g., an updraft) inside the image forming apparatus 100. The recess 38 defines an air duct (e.g., an air channel) that penetrates through the fixing device cover 31 vertically in the gravity direction parallel to a direction of the updraft, generating an air current by natural convection. Accordingly, the recess 38 causes the updraft to flow in the air duct vertically. The updraft moves an air current containing a substantial amount of water vapor inside the fixing device 300 upward, reducing the air current that blows against the non-contact temperature sensor 60 directly. Consequently, the non-contact temperature sensor 60 is less subject to condensation, detecting the temperature of the fixing belt 33 precisely.

Additionally, the rib 36 decreases the gap between the interior face 31*a* of the fixing device cover 31 and the rib 36 mounted on the frame 35, producing an enclosed space from the fixing belt 33 to the fixing device cover 31 and stabilizing an air current from an inside of a fuser unit (e.g., the interior defined by the fixing device cover 31). Additionally, the rib 36 reduces entry of an air current from an outside of the fixing device cover 31. Thus, the non-contact temperature sensor 60 is less susceptible to turbulence inside the fixing device 300, detecting the temperature of the fixing belt 33 stably and decreasing errors in detecting the temperature of the fixing belt 33.

A description is provided of a construction of a comparative fixing device.

Figure 6:
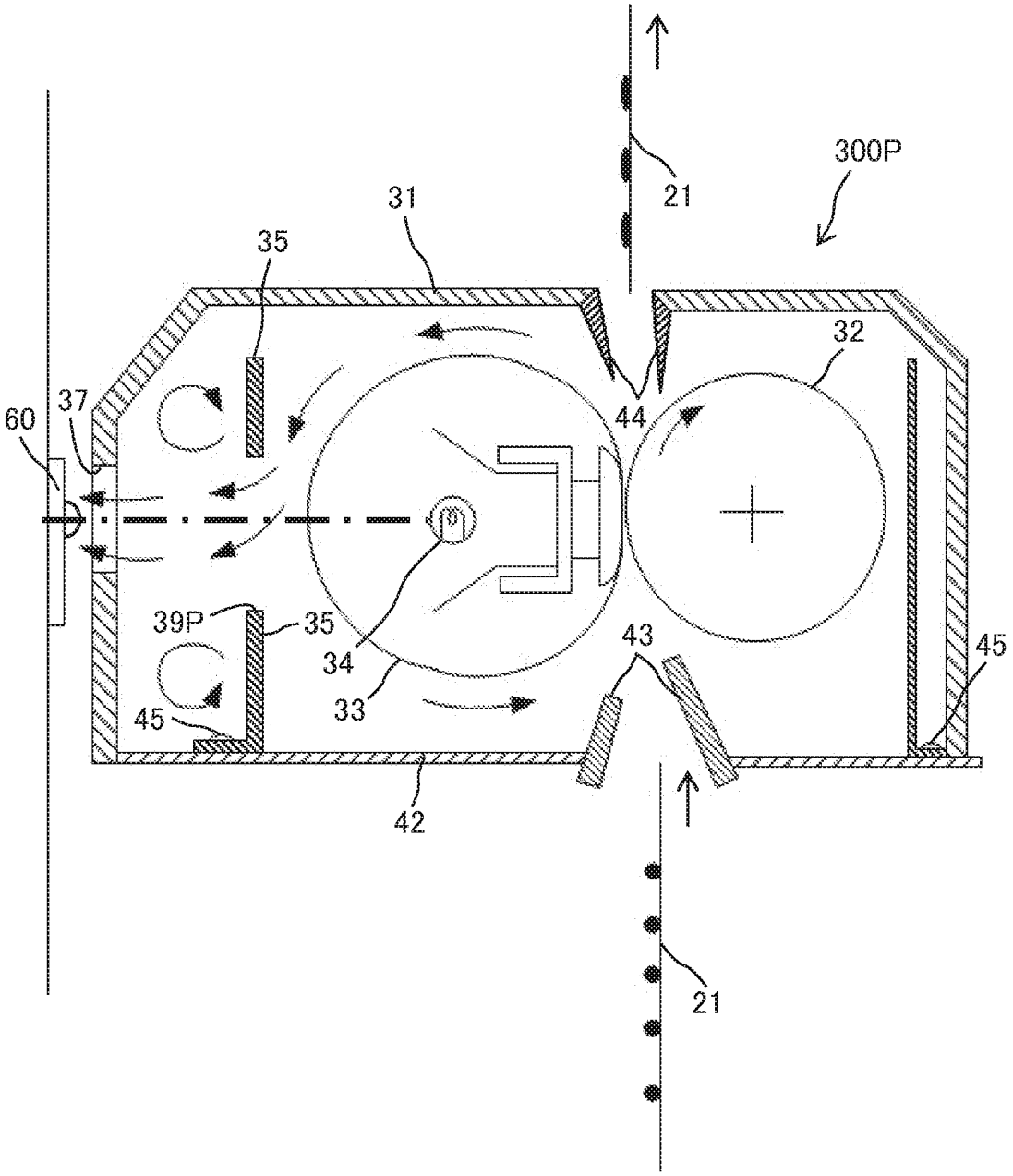
FIG. 6 Conventional Art
FIG. 6 is a cross-sectional view of a comparative fixing device.

FIG. 6 is a cross-sectional view of a fixing device 300P as one example of the comparative fixing device. In the fixing device 300P illustrated in FIG. 6, an air current containing water vapor inside the fixing device 300P reaches the non-contact temperature sensor 60 through the aperture 37 of the fixing device cover 31. The air current that has passed through an aperture 39P of the frame 35 produces turbulence inside the fixing device 300P (e.g., a gap between the fixing device cover 31 and the frame 35), that may adversely affect detection of the temperature of the fixing belt 33 by the non-contact temperature sensor 60.

Figure 7:
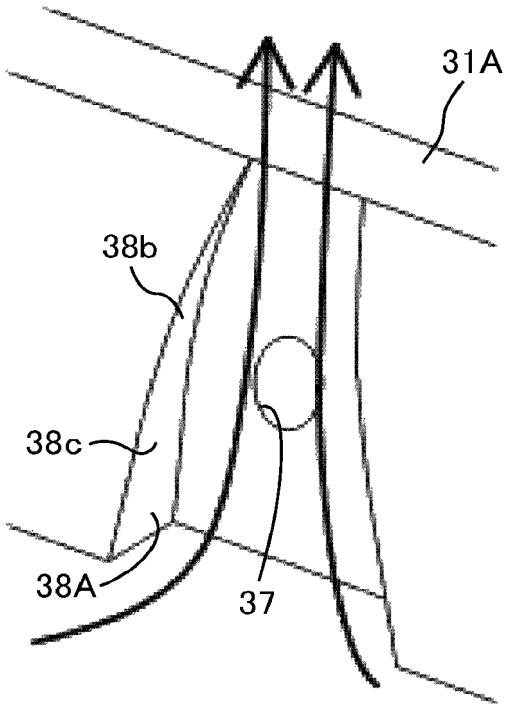
FIG. 7 is a perspective view of a fixing device cover and a recess according to a second embodiment of the present disclosure.

Referring to FIG. 7, a description is provided of a construction of the fixing device 300 according to a second embodiment of the present disclosure.

For example, a description is provided of a configuration of a recess 38A disposed in a fixing device cover 31A according to the second embodiment as a modification example of the recess 38 disposed in the fixing device cover 31 depicted in FIG. 5.

FIG. 7 is a perspective view of the fixing device cover 31A and the recess 38A disposed in the fixing device cover 31A according to the second embodiment. FIG. 7 illustrates the recess 38A disposed in the fixing device cover 31A and a periphery of the recess 38A and omits illustration of other components.

The fixing device cover 31A includes an upper portion and a lower portion in the gravity direction. A width of the upper portion is smaller than a width of the lower portion in a width direction of the fixing device cover 31A, that is perpendicular to the gravity direction. The recess 38A (e.g., an air duct) includes an upper portion 38*b* and a lower portion 38*c* in the gravity direction, that are in the upper portion and the lower portion of the fixing device cover 31A, respectively. A cross-sectional area of a cross section, perpendicular to the gravity direction, of the upper portion 38*b* of the recess 38A is smaller than a cross-sectional area of a cross section, perpendicular to the gravity direction, of the lower portion 38*c* of the recess 38A. For example, the cross-sectional area of the recess 38A decreases gradually from the lower portion 38*c* to the upper portion 38*b*. Alternatively, the cross-sectional area of the recess 38A may decrease gradually from an arbitrary position to the upper portion 38*b*. The fixing device cover 31A preferably includes the recess 38A that includes the upper portion 38*b* disposed above the arbitrary position vertically in the gravity direction. For example, at least a cross-sectional area of the upper portion 38*b* is smaller than a cross-sectional area of the lower portion 38*c* of the recess 38A at the arbitrary position.

The recess 38A accelerates or facilitates generation of an updraft by stack effect.

Alternatively, the upper portion of the fixing device cover 31A may be smaller than the lower portion of the fixing device cover 31A also in a diagonal direction in addition to the width direction. Yet alternatively, a combination of the fixing device cover 31A and a component inside the body of the image forming apparatus 100, that is disposed opposite the fixing device cover 31A, may create a similar shape of an air duct.

A description is provided of a construction of a fixing device 300A according to a third embodiment of the present disclosure.

For example, a description is provided of a configuration of a rib 36A according to the third embodiment as a modification example of the rib 36 attached to the frame 35 depicted in FIG. 5.

Figure 8:
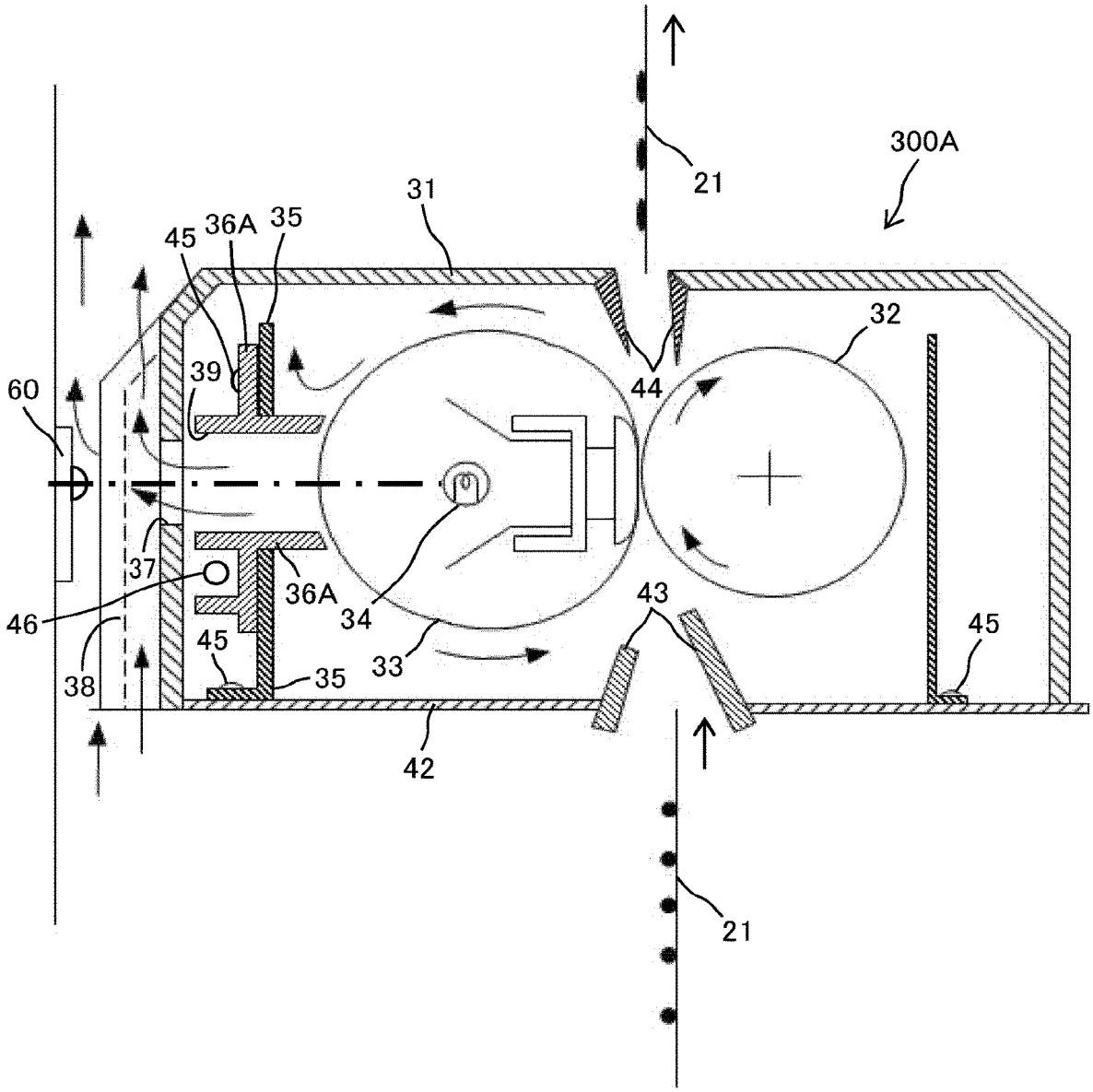
FIG. 8 is a cross-sectional view of a fixing device incorporating a rib according to a third embodiment of the present disclosure, illustrating one example of the rib.

FIG. 8 is a cross-sectional view of the fixing device 300A, illustrating one example of a shape of the rib 36A according to the third embodiment. For example, the rib 36A mounted on the frame 35 extends inward beyond the frame 35 toward the fixing belt 33. The aperture 37 of the fixing device cover 31 is surrounded by the rib 36A that extends toward the fixing belt 33. The rib 36A decreases a gap between the frame 35 and the fixing belt 33, reducing discharging of an air current containing water vapor, that is discharged from the sheet 21.

Alternatively, the rib 36A may extend outward and inward from the frame 35. The rib 36A may be constructed of a single part or a plurality of parts.

Figure 9B:
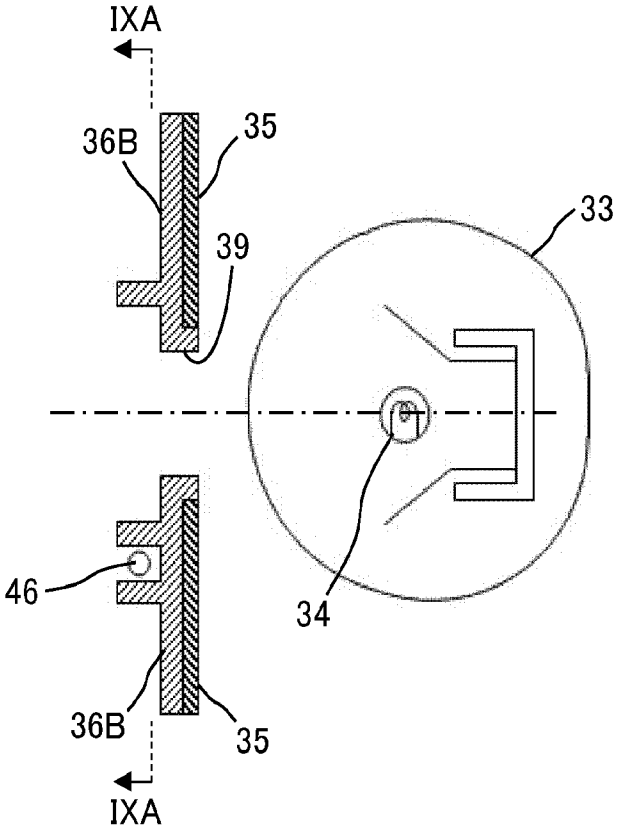
FIG. 9B is a cross-sectional view of the rib taken on line IXB-IXB in FIG. 9A.
Figure 9A:
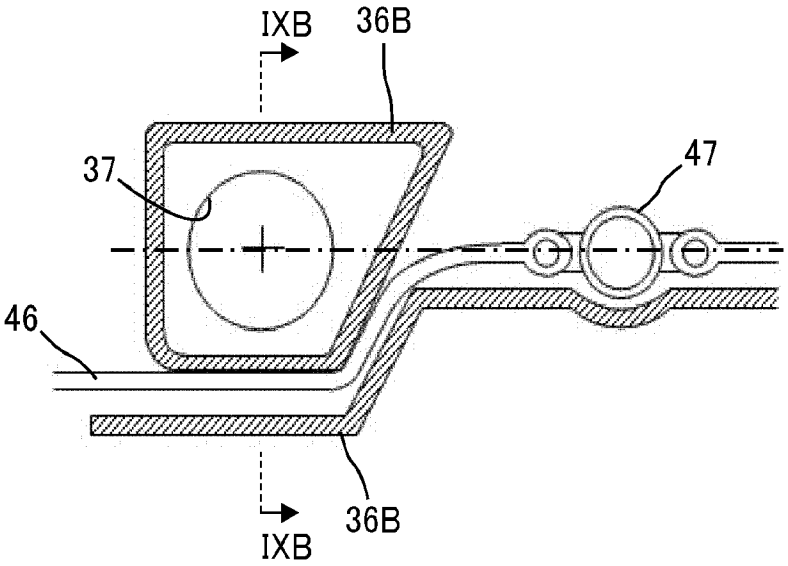
FIG. 9A is a cross-sectional view of a rib as another example of the rib according to the third embodiment depicted in FIG. 8.

Referring to FIGS. 9A and 9B, a description is provided of a configuration of a rib 36B as another modification example of the rib 36 depicted in FIG. 5.

FIGS. 9A and 9B illustrate a main section relating to an example of a shape of the rib 36B that also serves as a harness guide that guides a harness 46 routed around a vicinity of the rib 36B. FIGS. 9A and 9B omit illustration of other section.

The rib 36B, as a modification example of the rib 36 depicted in FIG. 5, guides and secures a wire of the harness 46. FIG. 9A is a cross-sectional view of the rib 36B and the vicinity thereof taken on line IXA-IXA depicted in FIG. 9B. FIG. 9B is a cross-sectional view of the rib 36B and the vicinity thereof taken on line IXB-IXB depicted in FIG. 9A. An alternate long and short dash line in FIGS. 9A and 9B indicates a center of the lens of the non-contact temperature sensor 60.

FIG. 9A illustrates an example of an overheating prevention device 47 (e.g., a thermostat) as an electrical part disposed in proximity to the rib 36B. The harness 46 coupled to the overheating prevention device 47 is a primary wire that is thick and is not routed easily.

As illustrated in FIG. 9A, the harness 46 is routed along the rib 36B having an increased mechanical strength, thus being secured to the rib 36B stably. Accordingly, the rib 36B prevents the harness 46 from interfering with the aperture 37, that is, a temperature detection window, of the fixing device cover 31. If the rib 36B is made of resin, the rib 36B also thermally insulates the aperture 37 from the fixing belt 33 heated to a high temperature advantageously.

FIGS. 9A and 9B illustrate an example of the rib 36B that serves as the harness guide obtained by deforming the rib 36 depicted in FIG. 5. Alternatively, the configuration of the rib 36B may be applied to the rib 36A depicted in FIG. 8 and the like.

The above describes the embodiments of the present disclosure. Two or more of the above-described embodiments may be combined.

Further, the technology of the present disclosure is not limited to the embodiments described above. The components and the elements of the embodiments described above may be modified, added, and converted into configurations suggested readily by those skilled in art within the scope of the present disclosure.

A description is provided of advantages of a fixing device (e.g., the fixing devices 200, 200A, 300, and 300A).

As illustrated in FIG. 5, the fixing device includes a detected object (e.g., the fixing belts 33 and 201), a fixing device cover (e.g., the fixing device covers 31 and 31A), a structure (e.g., the frame 35), and a rib (e.g., the ribs 36, 36A, and 36B).

The detected object, of which temperature is detected by a non-contact temperature sensor (e.g., the non-contact temperature sensor 60), is disposed inside the fixing device. For example, the detected object is a rotator (e.g., the fixing belts 33 and 201) that rotates. The fixing device cover includes an interior face (e.g., the interior face 31*a*), that is disposed opposite the detected object, and a first aperture (e.g., the aperture 37), that is disposed opposite the detected object. The structure is interposed between the interior face of the fixing device cover and the detected object. The interior face of the fixing device cover is disposed opposite the detected object. The structure includes a second aperture (e.g., the aperture 39). The second aperture is disposed opposite the detected object and the first aperture. The rib is mounted on the structure and is extended from the second aperture toward the interior face of the fixing device cover. The fixing device cover includes a recess (e.g., the recesses 38 and 38A) that surrounds the first aperture and extends vertically in a gravity direction. The non-contact temperature sensor is disposed outside the fixing device cover. The non-contact temperature sensor detects the temperature of the detected object through the first aperture and the second aperture.

Accordingly, the fixing device allows the non-contact temperature sensor to detect the temperature of the detected object precisely with a simple construction.

According to the embodiments described above, each of the fixing belts 201 and 33 serves as a fixing rotator or a rotator. Alternatively, a fixing roller, a fixing film, a fixing sleeve, or the like may be used as a fixing rotator or a rotator.

Further, each of the pressure rollers 203 and 32 serves as a pressure rotator or a rotator. Alternatively, a pressure belt or the like may be used as a pressure rotator or a rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:
- a rotator configured to rotate;
- a fixing device cover including:
  - an interior face disposed opposite the rotator;
  - a first aperture disposed opposite the rotator; and
  - a recess configured to surround the first aperture extend in a gravity direction;
- a frame interposed between the interior face of the fixing device cover and the rotator, the frame including a second aperture disposed opposite the rotator and the first aperture; and
- a rib mounted on the frame, the rib configured to extend from the second aperture toward the interior face of the fixing device cover.

2. The fixing device according to claim 1, wherein the rib is configured to extend toward the rotator.

3. The fixing device according to claim 1, wherein the rib is configured to surround the first aperture.

4. The fixing device according to claim 1, wherein the rib is configured to extend toward the rotator and surround the first aperture.

5. The fixing device according to claim 1, wherein the recess includes:
- a first portion disposed above an arbitrary position in the gravity direction; and
- a second portion disposed at the arbitrary position.

6. The fixing device according to claim 5, wherein a cross-sectional area of a cross section, perpendicular to the gravity direction, of the recess is configured to decrease gradually from the arbitrary position to the first portion.

7. The fixing device according to claim 5, wherein a cross-sectional area of a cross section, perpendicular to the gravity direction, of the first portion is configured to be smaller than a cross-sectional area of a cross section, perpendicular to the gravity direction, of the second portion.

8. The fixing device according to claim 1, further comprising a harness configured to be guided by the rib.

9. The fixing device according to claim 8, wherein the harness is configured to be routed along the rib.

10. The fixing device according to claim 1, wherein the rotator includes a fixing belt.

11. An image forming apparatus, comprising:
- a fixing device configured to fix an image on a recording medium; and
- a non-contact temperature sensor disposed outside the fixing device,
- the fixing device including:
  - a detected object of which temperature is configured to be detected by the non-contact temperature sensor;
  - a fixing device cover including:
    - an interior face disposed opposite the detected object;
    - a first aperture disposed opposite the non-contact temperature sensor; and
    - a recess configured to surround the first aperture and extend in a gravity direction;
  - a frame interposed between the interior face of the fixing device cover and the detected object, the frame including a second aperture disposed opposite the non-contact temperature sensor; and
  - a rib mounted on the frame, the rib configured to extend from the second aperture toward the interior face of the fixing device cover.

12. The image forming apparatus according to claim 11,
- wherein the non-contact temperature sensor is disposed outside the fixing device cover, and
- wherein the non-contact temperature sensor is configured to detect the temperature of the detected object through the first aperture and the second aperture.

13. The image forming apparatus according to claim 11, wherein the detected object includes a fixing belt.

* * * * *